United States Patent [19]

Bolling

[11] Patent Number: 4,993,563

[45] Date of Patent: Feb. 19, 1991

[54] STACKING AND BUNDLING APPARATUS

[76] Inventor: Ambrose Bolling, 2808 Weir Ave., Weirton, W. Va. 26062

[21] Appl. No.: 446,122

[22] Filed: Dec. 5, 1989

[51] Int. Cl.[5] ..... A47F 5/00

[52] U.S. Cl. ..... 211/175; 100/34

[58] Field of Search ..... 211/50, 49.1, 175; 206/83.5, 442; 53/592, 590, 390, 257; 100/34; 220/8; 108/53.1, 53.5, 53.3, 55.1, 55.3

[56] References Cited

U.S. PATENT DOCUMENTS

| | | | |
|---|---|---|---|
| 78,142 | 5/1868 | Siecke | 53/592 X |
| 1,229,006 | 6/1917 | Zerwer | 100/34 |
| 1,736,172 | 11/1929 | Raymond | 108/55.1 |
| 2,839,990 | 6/1958 | Bailar | 100/34 |
| 3,494,279 | 2/1970 | Sylvester et al. | 100/1 |
| 3,727,543 | 4/1973 | Morrow et al. | 100/1 |
| 3,850,092 | 11/1974 | Montgomery | 100/34 |
| 3,897,724 | 8/1975 | McDonald | 100/34 |
| 4,029,078 | 6/1977 | Eller | 211/175 X |
| 4,061,084 | 12/1977 | Bakkeren | 100/34 X |
| 4,154,159 | 5/1979 | Ortega | 211/50 X |
| 4,167,903 | 9/1979 | Lasher | 100/34 |
| 4,193,340 | 3/1980 | Finn | 100/34 |
| 4,298,126 | 11/1981 | Filipowicz | 211/50 |
| 4,395,941 | 8/1983 | Metzger | 100/34 |
| 4,523,722 | 6/1985 | Cohen | 211/175 |
| 4,681,032 | 7/1987 | McDermott | 100/34 |
| 4,715,502 | 12/1987 | Salmon | 211/175 X |

*Primary Examiner*—Carl D. Friedman
*Assistant Examiner*—Daniel Hulseberg
*Attorney, Agent, or Firm*—Carothers & Carothers

[57] ABSTRACT

An apparatus for stacking and bundling scrap cardboard and similar materials which includes an adjustable base frame with extensible sections to accommodate varying sizes of scrap material and a plurality of selectively removable uprights distributed about the perimeter of the base frame to confine such scrap material in the apparatus, the invention further contemplating strap guide means adapted to receive elongated binding straps for passing thereof about a quantity of such scrap material for binding or baling thereof.

7 Claims, 1 Drawing Sheet

STACKING AND BUNDLING APPARATUS

BACKGROUND OF THE INVENTION

This invention concerns apparatus for collecting and confining scrap material such as cardboard sheet or collapsed cardboard boxes in a neat and organized fashion to thereby facilitate baling or binding of a quantity of such scrap material into a bale and subsequent convenient removal of the bale from the apparatus.

Retail stores face a constant waste disposal problem in that a great deal of the goods carried by retail stores are shipped to the stores from distributors or manufacturers in large cartons of paperboard construction. In larger retail outlets, the volume of waste packing material is great enough to justify the investment in expensive and efficient mechanized waste paper collecting, compacting and baling apparatus; however, such apparatus typically is beyond the financial means of smaller retailers. Additionally, large mechanized baling apparatus takes considerable floor space and smaller retailers typically cannot justify the commitment of space required for such apparatus.

Of course, retailers per se are not the only businesses affected by this waste disposal problem. Any small business which receives goods or materials in paperboard packing cartons must find a way to dispose of the packing material. The problem is particularly vexing for those businesses which rely on high turnover for profitability since increases in turnover inherently add to the volume of waste packing material to be disposed of, in direct proportion to the volume of incoming goods.

The prior art is replete with examples of apparatus for collecting waste paper and similar materials. Examples include U.S. Pat. Nos. 4,193,340, 3,897,724, 4,298,126, 3,850,092, 4,395,941, and 4,681,032. Other patents pertinent to apparatus for use in strapping or bundling articles include U.S. Pat. Nos. 3,494,279 and 3,727,543.

BRIEF SUMMARY OF THE INVENTION

The present invention contemplates a stacking and bundling apparatus having an adjustable base frame which, according to one presently preferred embodiment of the invention, is adjustable by virtue of interfitted or telescoping framed sections that permit the frame to be adjusted selectively within a range between predetermined minimum and maximum length dimensions.

The apparatus also includes longitudinally and laterally extending binding strap guides preferably in the form of formed steel channels. The strap guides receive binding straps so that such straps may be conveniently passed about the material stacked in the apparatus for baling thereof. Typically, heavier waste material such as paperboard cartons require heavy duty straping such as steel banding for baling thereof and such steel banding, because it tends to coil spontaneously, cannot be simply laid in place on the base of a stacking apparatus prior to beginning a new stack of waste material therein. Instead, it is necessary when using steel banding to pass the banding beneath the completed stack of material and upward around the material for baling thereof. The binding strap guide means preferably also includes interfitted channel sections which maintain the continuity of the strap guides for all adjustments of the base frame length as above described.

The invention further contemplates a plurality of uprights carried at spaced locations along the periphery of the base frame to guide and confine the scrap material as it is stacked therein, thus maintaining the scrap material in a uniform stack on the base frame. The uprights are selectively removable from the base frame to facilitate removal of a bound or baled stack of scrap material from the apparatus. In addition, at least some of the removable uprights preferably are carried by the extensible portion of the base frame whereby the size of the confining space defined by the uprights is adjustable concomitantly with adjustment of the base frame.

The apparatus of this invention preferably is fabricated from angle or channel steel sections, although suitable alternative material such as high strength molded plastics may also be used.

It is therefore one object of the instant invention to provide a novel and improved sheet material stacking apparatus.

A further object of the invention is to provide a sheet material stacking apparatus which is selectively adjustable to accommodate different sizes of sheet material for stacking therein and which further accommodates the passing of strapping material about the materials stacked in the apparatus for baling thereof.

These and other objects and advantages of the invention will be more readily appreciated upon consideration of the following detailed description and the accompanying drawings, in which.

Figure 1:
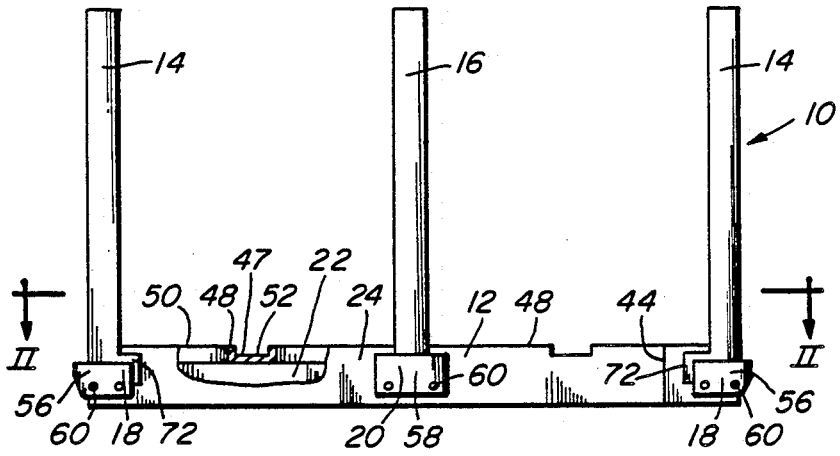
FIG. 1 is a side elevational view, partially broken away, of a stacking apparatus according to one presently preferred embodiment of the instant invention.
Figure 2:
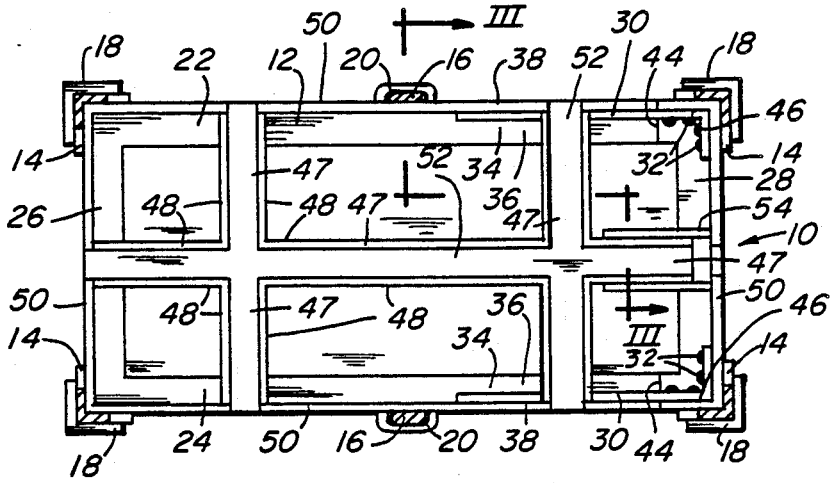
FIG. 2 is a sectioned plan view taken on line II—II of FIG. 1.

There is generally indicated at 10 in FIGS. 1 and 2 a stacking apparatus constructed to one presently preferred embodiment of the instant invention and comprising a fabricated base 12 and a plurality of selectively removable uprights, including corner uprights 14 and intermediate uprights 16, which are retained with respect to base 12 as by respective retention pockets 18 and 20.

Base 12 is fabricated preferbly from angle steel sections and includes a pair of laterally spaced, longitudinally extending side portions 22 and 24 which are joined by a pair of longitudinally spaced end portions 26 and 28 to form the generally rectangular base frame 12.

At least one of the side or end portions, for example the end portion 28 as shown, is provided with a pair of elongated guides 30 which are rigidly affixed to the end portion 28 as by spot welding indicated at 32 so as to be coextensive with an adjacent longitudinal portion 34 of the respective side portions 22 and 24. As more clearly shown by the depiction of side portion 22 in FIG. 3, the side portions 22 and 24, like end portions 26 and 28, are angle section steel having a base portion 36 which projects inwardly of the base frame 12, and an upstanding side wall portion 38 which projects upwardly from the outermost part of base portion 36. Guides 30 are slideable upon an upper surface 40 of base portion 36 adjacent an inwardly facing surface 42 of the upstanding side wall 38.

As shown in FIGS. 1 and 2, the side portions 22 and 24 terminate at a cut line 44 adjacent end portion 28 and that part of the side portions 22 and 24 beyond the cut line 44 is integral with end portion 28 to thereby form a right angle corner configuration 46 into which the corresponding angled base portion of the respective guides 30 may be received and retained by the weldments 32.

Accordingly, it will be seen that end portion 28 may be moved longitudinally inward and outward with respect to side portions 22 and 24 to thereby selectively alter the length of base 12 depending upon the size of the scrap materials to be stacked therein. Of course, the same adjustment structure may be provided for either of side portions 22, 24 to permit selective widening, in lieu of or in addition to lengthening, of the base 12.

Base 12 also includes longitudinally and/or transversely extending support members 47 having upper surface portions 48 which in, cooperation with upper surface portions 50 of the side walls 38, and corresponding surface portions of the ends 28, serve to provide support for waste materials to be stacked upon base 12. The support members 47 may be formed as upwardly opening channel sections, for example, defining respective elongated channels or recesses 52 which are adapted to receive strapping material such as steel strapping to be passed about a load of scrap material stacked upon base 12. That is, materials stacked upon base 12 will be supported upon surfaces 50 and 48 so that the channel recesses 52 provide clearance for passing strapping material beneath the stacked materials.

Adjacent the end portion 28, longitudinal support member 47 extends toward but is not affixed to end portion 28. Rather, another channel member 54 is affixed to end portion 28 and projects therefrom in interfitted telescoping relation with channel 47 to thereby maintain the continuity of support and clearance for strapping material throughout adjustment of the length of base 12 by movement of end portion 28.

Figure 3:
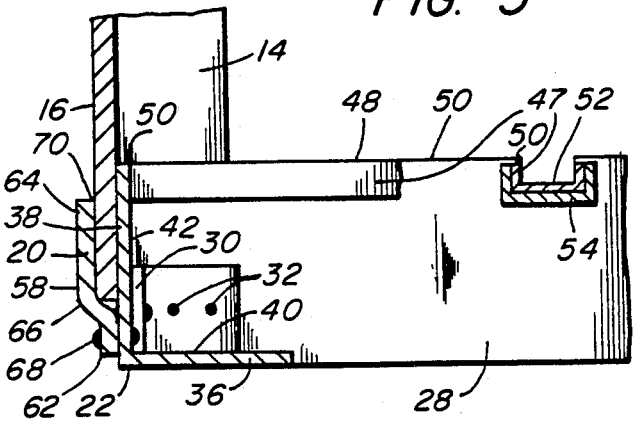
FIG. 3 is a partial section taken on line III—III of FIG. 2.

The uprights 14 and 16 are retained with respect to base 12 by means of the pockets 18 and 20, respectively, which are formed by the attachment of respective pocket plates 56 and 58 to the corners and side portions, respectively, of base 12, for example by spot welds 60 as shown. Referring more specifically to FIG. 3, one of side pockets 58 is shown as exemplary of all the described pockets and including a base portion 62, an outwardly offset upstanding retention portion 64, and an integral intermediate portion 66 extending therebetween. The pocket plate 58 is secured to the upstanding side wall portion 42 of member 22 as by riveting at 68, or alternatively by threaded nut and bolt fasteners, spot welding, or any other suitable means which will rigidly retain the pocket plate 58 with respect to the side wall portion 42. An upwardly opening cavity 70 is formed between pocket plate upstanding portion 64 and side wall portion 42 to receive the upright 16 and retain the same until it is to be removed by lifting the upright 16 out of recess 70.

Corner pockets 18 are similarly configured and similarly affixed with respect to base 12, except that they form a right angle configuration and may be secured to the two adjacent sides of each corner of base 12. For the corner pockets 18, the recess which receives the uprights is correspondingly a right angle recess, and the corner uprights 14 themselves, being right angle members rather than planer members, are thus received into the right angle pockets. More specifically, adjacent its base or lower end, each corner upright 14 includes tongue portions 72 which are adapted to be interfitted within the respective right angle corner recesses for retention of the uprightws 14 therein.

From the above description, the operation of the instant invention may be readily appreciated. The end portion 28 (or other adjustable portions of the base 12 as noted hereinabove) may be moved inwardly or outwardly at will to accommodate the specific size of flat waste material such as cardboard cartons to be deposited on base 12. Uprights 14 and 16 are placed within the respective pockets to be retained thereby with respect to base 12 as the waste material is stacked thereon to thus organize and retain the stack of material, and to facilitate a neat and precise stacking operation.

When a stack of the desired size has been created, banding material such as steel banding is passed beneath the stack of material by being fed within channels 52 and is then passed upwardly about the periphery of the stack of material, whereupon conventional manual banding equipment may be utilized to tightly band or bale the stack. Uprights 14 and 16 may then be removed as needed to provide clearance for sliding or rolling the bale off of base 12 and the respective uprights are then replaced in their installed positions on base 12. A new stack of waste material may then be started.

According to the description hereinabove I have invented a novel and improved stacking apparatus. Of course, I have envisioned various alternative and modified embodiments apart from those disclosed hereinabove, and certainly such would also occur to others versed in this art once they were apprised of my invention. Accordingly, it is my intention that the invention be construed broadly and limited only by the scope of the claims appended hereto.

I claim:

1. A stacking apparatus comprising:

a base assembly including a first pair of laterally spaced, longitudinally extending portions and a second pair of longitudinally spaced portions extending between and connected to said first pair of portions to form a generally polygonal frame enclosing an area;

elongated means extending within said area between at least one said pair of portions and supported thereby;

said elongated means being cooperable with said pairs of portions to provide support within said area for articles stacked upon said base assembly;

said elongated means including an upwardly open channel extending substantially continuously throughout the length of said elongated means, said channel being open ended for access thereto from locations laterally outward of said at least one pair of portions;

a plurality of uprights adapted to be carried by said polygonal frame at selected locations spaced about the periphery thereof;

said polygonal frame including retention means adjacent said selected locations for selectively retaining and supporting said uprights in an upstanding orientation with respect thereto; and means permitting the said portions of at least one of said pairs of portions to be selectively moveable with respect to each other for adjustment of the spacing therebetween to thereby adjust the size of said area while maintaining support of said elongated means; and said at least one said pair of portions including interengaged guide means which are relatively moveable in telescoping relationship to guide the said portions of said at least one said pair of portions throughout selective movement thereof with respect to each other.

2. The apparatus as set forth in claim 1 wherein said elongated means includes longitudinally interfitted portions which are moveable longitudinally with respect to each other upon selective movement of said one pair of portions with respect to each other to thereby selectively extend and retract said elongated means and said upwardly open channel in response to selective movement of said pair of portions to respectively increase and decrease the spacing therebetween.

3. The apparatus as set forth in claim 2 wherein said retention means includes upwardly open pocket means for receiving base portions of the respective said uprights.

4. The apparatus as set forth in claim 3 wherein said elongated means additionally includes upwardly facing surface portions adapted to provide support for such articles.

5. The apparatus as set forth in claim 4 wherein at least one of said pocket means is carried by each of said one pair of portions such that the spacing between the said uprights received in the respective said pockets increases and decreases in response to relative movement between said pair of portions.

6. An apparatus for stacking and baling waste material comprising:

an open base comprised of a plurality of elongated side elements forming a closed polygon which encompasses an area;

each of said side elements including upwardly facing surface portions defining a peripheral surface of said base which is adapted to support such waste material;

support elements extending longitudinally and transversely of said base within said area and supported by respective ones of said side elements, said support elements including other upwardly facing surface portions which are cooperable with said first mentioned surface portions to support such waste material;

said support elements further including open ended recess means which are coextensive with said other surface portions and which open laterally outwardly of said ones of said side elements to provide clearance to pass strapping material from laterally outward of said ones of said side elements beneath such waste material supported on said base;

upstanding support means carried by said base at selected locations spaced about the periphery thereof and supported with respect to said base by retention means carried by respective ones of said side elements;

said upstanding support menas selectively removable from said retention means;

at least one of said side elements being relatively moveable with respect to the remainder of said side elements for adjusting the size of said area; and at least one of said support elements being adjustable in length in response to said relative movement of said one side element.

7. The apparatus as set forth in claim 6 wherein at least one of said upstanding support means is carried by said at least one of said side elements and the spacing between said at least one of said upstanding support means and another of said upstanding support means is adjustable in response to said relative movement of said one side elements.

* * * * *